US007441310B2

(12) United States Patent
Chen

(10) Patent No.: US 7,441,310 B2
(45) Date of Patent: Oct. 28, 2008

(54) PLIABLE HANDLE ON WHICH A BUTTON CAN BE INSTALLED

(75) Inventor: Chien-Hung Chen, Xiamen (CN)

(73) Assignee: Xiamen Jundian House Omaments Co., Ltd., Xiamen (CN)

( * ) Notice: Subject to any disclaimer, the term of this patent is extended or adjusted under 35 U.S.C. 154(b) by 445 days.

(21) Appl. No.: 11/262,390

(22) Filed: Oct. 28, 2005

(65) Prior Publication Data

US 2007/0094848 A1 May 3, 2007

(51) Int. Cl.
*A45C 13/26* (2006.01)

(52) U.S. Cl. ..... 16/430; 16/431; 16/DIG. 12

(58) Field of Classification Search ..... 16/430, 16/431, 436, 421, DIG. 12, DIG. 19, 435; 135/24, 25.4; 190/115; D8/5, 6, 10, 12; 280/821; 81/489; 15/144.1–144.4
See application file for complete search history.

(56) References Cited

U.S. PATENT DOCUMENTS 5,220,707 A * 6/1993 Newman et al. ..... 16/429
6,832,413 B1 * 12/2004 Applewhite et al. ..... 16/430
6,968,599 B2 * 11/2005 Blauer et al. ..... 16/431
2004/0205937 A1 * 10/2004 Blauer et al. ..... 16/431
2004/0205938 A1 * 10/2004 Blauer et al. ..... 16/431
2005/0155186 A1 * 7/2005 McGuyer et al. ..... 16/430
2006/0169308 A1 * 8/2006 Yen et al. ..... 135/25.4
2006/0174450 A1 * 8/2006 Chen ..... 16/436

* cited by examiner

*Primary Examiner*—Victor Batson
*Assistant Examiner*—Jeffrey O'Brien
(74) *Attorney, Agent, or Firm*—Greer, Burns & Crain, Ltd.

(57) ABSTRACT

A pliable handle on which a button can be installed, includes a rigid core member, a bore in the rigid plastic core member along the longitudinal axis for locking the bottom of the central rod; a flexible outer sheath is disposed about the core member hermetically, and deformable gel is disposed between the core member and the outer sheath. A space for receiving the button which can move in radial direction is set in the core member, a through opening for button to be inserted through is disposed in the side wall of the core member, the side wall corresponds to the space; an outer annular flange is formed on the exterior surface of the core member which corresponds to the through opening; an opening is set on the flexible outer sheath for containing the outer annular flange of the core member.

6 Claims, 8 Drawing Sheets

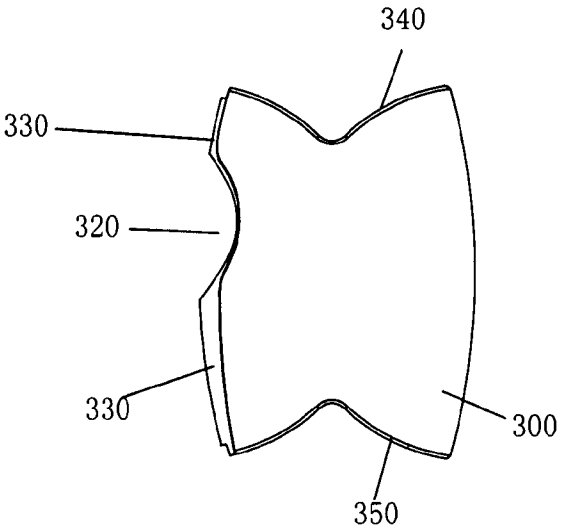
Fig 6-1
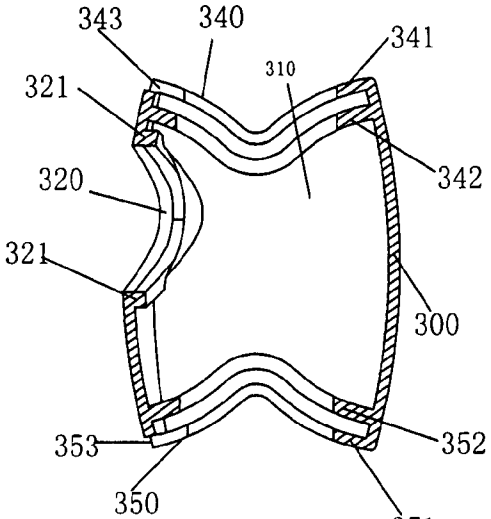
Fig 6-2
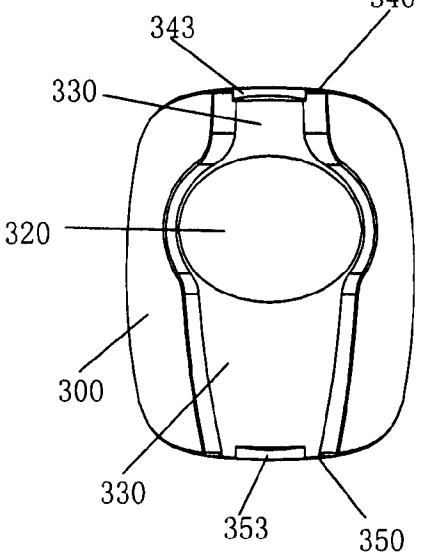
Fig 6-3
Fig 7-1
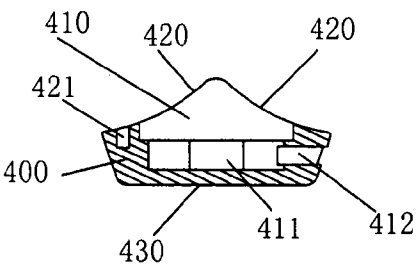
Fig 7-2
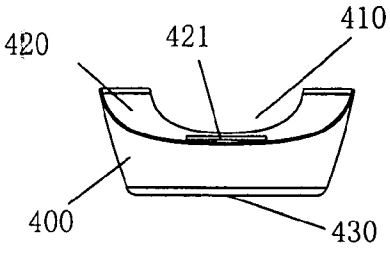
Fig 7-3

PLIABLE HANDLE ON WHICH A BUTTON CAN BE INSTALLED

FIELD OF INVENTION

The present invention generally relates to handles of hand-held devices, such as handles of walking sticks, umbrellas and fishing poles.

BACKGROUND

All kinds of pliable handles based on known technology have a flexible outer sheath disposed about the core member hermetically, and deformable gel that is disposed between the core member and the outer sheath. In the structure of the pliable handle shown in FIG. 1, there is a bore 100" in the rigid plastic core member 1" along the longitudinal axis of the core member, and there is an upper groove 101" on the top of the core member 1", and a lower groove 102" at the bottom of the core member 1". A cylindrical outer sheath 2", which is made of flexible rubber, has a flange in its top portion extending inwardly and downwardly, forming an upper flange 21". The sheath 2" has a flange in its bottom portion extending inwardly and upwardly, forming a lower flange 22". The upper flange 21" of the outer sheath is wedged into the upper groove 101" of the core member 1". The lower flange 22" of the outer sheath 2" is wedged into the lower groove 102" of the core member 1". The rigid plastic upper cap 11" is mushroom-shaped, and there is an opening through its center, where its petiole is inserted into the central bore 100" of the core member 1", and fixed in place. The outer flange of the upper cap 11" makes the top of the outer sheath 2" press on the top of the core member 1" tightly to form a seal therein. The rigid plastic lower cap 12" is mushroom-shaped, and there is an opening in its center, where its petiole is inserted into the central bore 100" of the core member 1", and fixed in place. The outer flange of the lower cap 12" makes the bottom of the outer sheath 2" press on the bottom of the core member 1" tightly to form a seal thereon. The diameter of the central bore of the upper cap 11" is the same as the diameter of the central bore of the lower cap 12". The middle of the outer sheath 2" protrudes outwardly and the outer surface of the core member 1" is concave inwardly. The gap between the inner surface of the outer sheath 2" and the outer surface of the core member 1" can be filled with the gel 3" which is deformable. Because the pliable handle has a flexible outer surface and a hard core, the core member 1" provides a secure grip. The outer sheath 2" and the gel 3" will change to conform to the shape of the hand. So the pliable handle provides a comfortable grip.

For controlling the unfurling and furling in some hand-held umbrellas, there is a clasp in the central rod of an umbrella. The clasp is attached to a slip cover to which many subordinate rods of the umbrella are connected. When the umbrella is furled, the clasp locked the slip cover and made the umbrella furl. The clasp is connected to a button, and after pressing the button the clasp is detached from the slip cover to cause the umbrella to unfurl. When the umbrella is furled, the clasp locks the slip cover again. For beauty and convenience of use, a through opening is set in the side wall of the core member, containing a button. When people grip the pliable handle, they press the button with their thumb, causing the clasp to detach from the slip cover, and the umbrella to unfurl. According to the structure of above-mentioned pliable handle, a through opening contains a button in the side wall of the core member. When people grip the pliable handle, the gel may leak from the gap between the through opening and the button into the space between the inside of the core member and central rod of umbrella, which may hinder the movement of the button. Additionally, the gel may leak from the gap between the outer sheath and the button and go out of the outer sheath.

Some handles of hand-held devices, such as the handles of walking sticks and fishing poles, that are used at night and for caution, include a through opening set in the side wall of the core member, that contains a button battery, small bulb, luminous diode and so forth and a button switch. When people grip the pliable handle, they press the button switch with their thumb, causing the button battery and luminous components to form a closed circuit in series. The pliable handle radiates at night by the light of an electrical luminous component, so people who are far away can get the caution, and know the position of the user. Handles having a button component and the structure of the above-mentioned pliable handles have gel-leak problems.

SUMMARY

The present utility model provides a pliable handle including a button, in which the gel does not leak into the inside of the core member and out of the outer sheath. The shape of the pliable handle also has an aesthetically pleasing appearance.

A pliable handle on which a button can be installed comprises a rigid core member with a bore set in the core member along the longitudinal axis of the core member for locking the bottom of the central rod. A flexible outer sheath is disposed about the core member hermetically, and a deformable gel is disposed between the core member and the outer sheath.

In the core member there is a space for containing the button which can move in a radial direction, and there is a through opening for receiving the button in the side wall of the core member, the side wall corresponds to the space and an outwardly extending annular flange or an outer annular flange is formed on the exterior surface of the core member corresponding to the through opening. An opening is set on the flexible outer sheath for receiving the outer annular flange of the core member. The opening of the outer sheath covers the outer annular flange of the core member.

For enhancing the seal between the outwardly extending annular flange of the core member and the upper opening of the outer sheath: an annular groove is set on the outer surface of the upper outer flange of the core member. An inwardly extending annular flange is set inside of the upper opening of the outer sheath. The inwardly extending annular flange of the outer sheath wedges into the groove of the outer flange of the core member.

A rigid cover board of a button bore, which corresponds to the through opening, is pressed on the vicinity of the opening of the outer sheath, the opening of the outer sheath hermetically covers the outer flange of the core member.

A structure of cover board, which is beautiful and assembled easily, includes:

The cover board has two securing flanges, which extend upwardly and downwardly respectively. The two securing flanges correspond to the top and the bottom of the core member respectively.

Specially, a rigid upper cap is set on the top of the core member, a rigid lower cap is set on the bottom of the core member; there are two outwardly extending annular shoulders around the top portion and the bottom portion of the core member, and there is a hermetical annular groove in the middle of each shoulder; two hermetical loops are set at the top and at the bottom of the core member, the two hermetical loops are parallel and extend inwardly. The upper hermetical loop on the top of the outer sheath is wedged into the gap between the core member and the upper cap, the lower hermetic loop on the top of the outer sheath is wedged into the hermetical groove of upper shoulder of the core member; the lower hermetic loop at the bottom of the outer sheath is wedged into the gap between the core member and the lower cap. The upper hermetical loop at the bottom of the outer sheath is wedged into the hermetical groove of lower shoulder of the core member. Further, the ends of securing flanges of the cover board are secured to the upper cap and lower cap, respectively.

Preferably, two bores are respectively formed on the upper cap and the said lower cap, the ends of securing flanges of the cover board are wedged into the bores on the upper cap and the lower cap, respectively.

A method of forming a pliable handle on which a button can be installed, wherein the steps are as follows:

Provide a rigid core member inside which a space for receiving a button which is moveable in a radial direction is provided, a through opening corresponding to the space for the button is disposed on the side wall of the core member, an outwardly extending annular flange corresponding to the through opening is provided on the outer wall of the core member, and an annular groove is disposed on the outer surface of the outwardly extending annular flange;

A flexible outer sheath is provided which can be disposed about the core member hermetically, the flexible outer sheath includes an opening for receiving the outwardly extending annular flange of the core member, an inwardly extending annular flange is disposed on the bottom of the inner surface of the opening of the outer sheath;

Get suitable capacity of gel according to the capacity of the gel containing space defined between the flexible outer sheath and the core member;

Have the gel cover one side of the outer surface of the core member where it is away from the outwardly extending annular flange;

Enlarge the top opening of the flexible outer sheath to enable the flexible outer sheath to be sleeved about the core member;

Align the opening of the outer sheath with the outwardly extending annular flange of the core member to have the inwardly extending annular flange of the opening of the outer sheath be inserted into the recess of the outwardly extending annular flange of the core member, the gel is sealed between the outer surface of the core member and a portion of the inner wall of the outer sheath where is away from the opening of the outer sheath.

The present device features a pliable handle on which a button can be installed, the outwardly extending annular flange of the through opening of the side wall of the core member cooperates with the opening of the flexible outer sheath, a rigid cover board presses on the opening of the outer sheath, the opening of the outer sheath covers the outwardly extending annular flange of the core member hermetically. Effectively, the gel-leak from the through opening of side wall of the core member into the inner of the core member and from the opening of the outer sheath is prevented. It retains the comfortable grip, and provides a facility for assembling the button. The inner flange of the outer sheath wedges into the groove of the outer flange of the core member, further, enhancing the seal between the outer flange of the core member and the opening of the outer sheath. Specifically, a rigid upper cap and a rigid lower cap are set at the bottom and on the top of the core member, fixing and sealing the proximal end and distal end of the outer sheath, the ends having two hermetical loops, respectively, the ends of the securing flanges are fixed on the upper cap and the lower cap respectively; the seal between the core member and the proximal end, the distal end of the outer sheath is good and the assembly is easy. Bores are set on the upper cap and the lower cap, fixing the ends of the securing flanges of the securing cover board, making a simple structure that is easy for implementing and assembling.

BRIEF DESCRIPTION OF THE DRAWINGS

FIG. 4-1 is a front view of the upper cap of the embodiment of FIG. 2.

FIG. 4-2 is a cross-sectional view of the upper cap of the embodiment of FIG. 2.

FIG. 4-3 is a right side view of the upper cap of the embodiment of FIG. 2.

FIG. 5-1 is a front view of the core member of the embodiment of FIG. 2.

FIG. 5-2 is a cross-sectional view of the core member of the embodiment of FIG. 2.

FIG. 5-3 is a right side view of the core member of the embodiment of FIG. 2.

FIG. 6-1 is a front view of the outer sheath of the embodiment of FIG. 2.

FIG. 6-2 is a cross-sectional view of the outer sheath of the embodiment of FIG. 2.

FIG. 6-3 is a right view of the outer sheath of the embodiment of FIG. 2.

FIG. 7-1 is a front view of the lower cap of the embodiment of FIG. 2.

FIG. 7-2 is a cross-sectional view of the lower cap of the embodiment of FIG. 2.

FIG. 7-3 is a right side view of the lower cap of the embodiment of FIG. 2.

FIG. 8-1 is a front view of the cover board of the embodiment of FIG. 2.

FIG. 8-2 is a cross-sectional view of the cover board of the embodiment of FIG. 2.

FIG. 8-3 is a right view of the cover board of the embodiment of FIG. 2.

DETAILED DESCRIPTION

Figure 1:
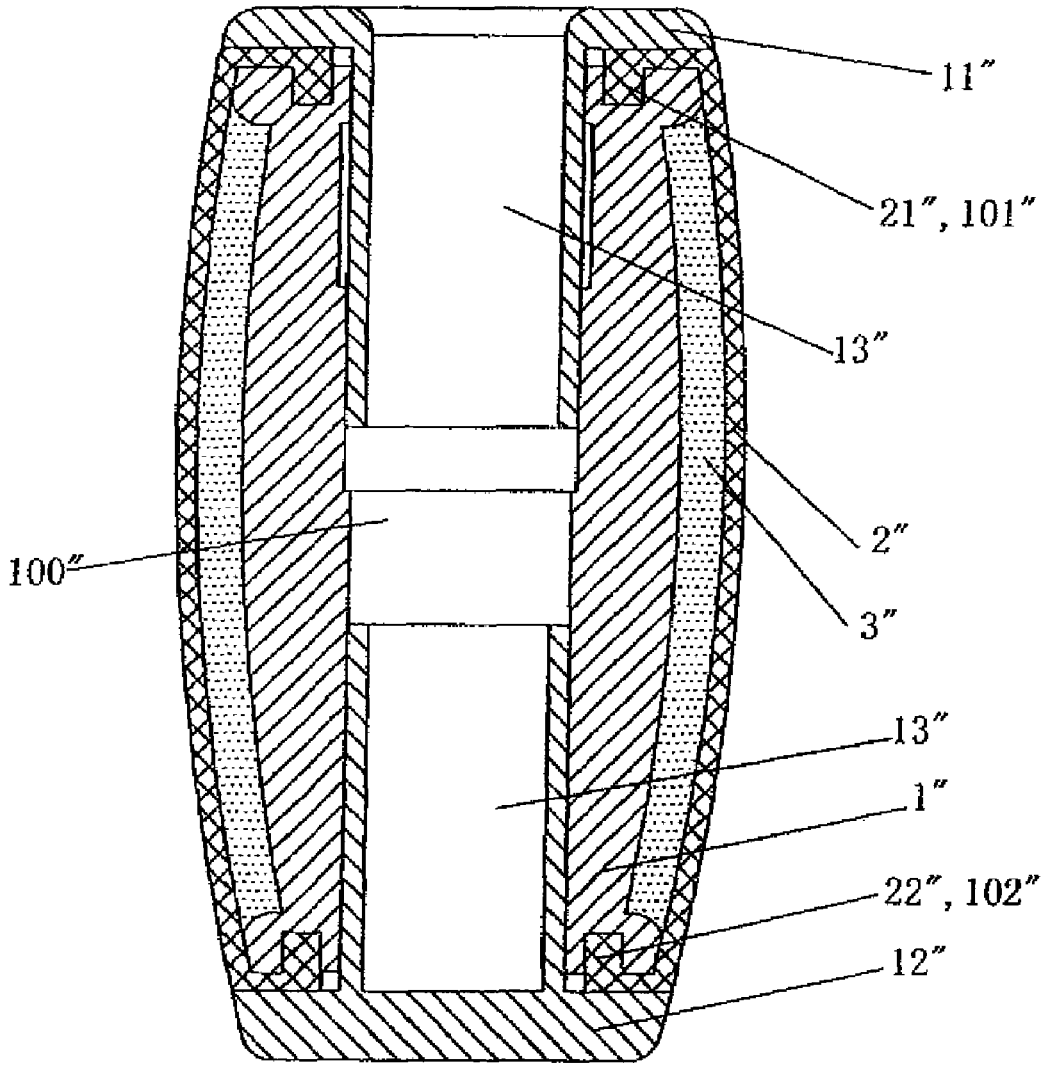
Fig 1 Prior Art
FIG. 1 is a cross-sectional view of the pliable handle based on the existing technology.
Figure 2:
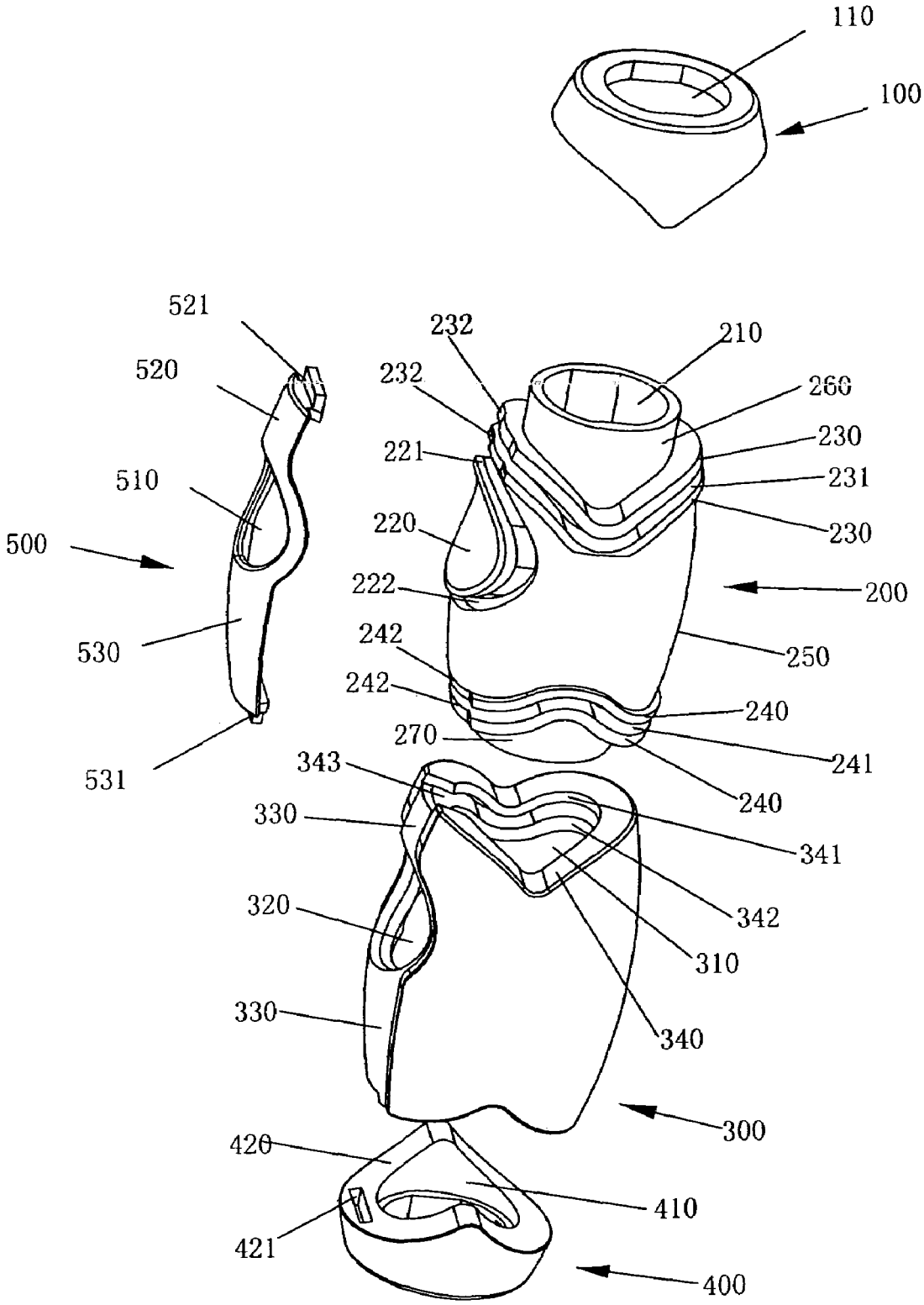
FIG. 2 is an exploded perspective view of an embodiment of the pliable handle of the present invention on which a button is installed.
Figure 3:
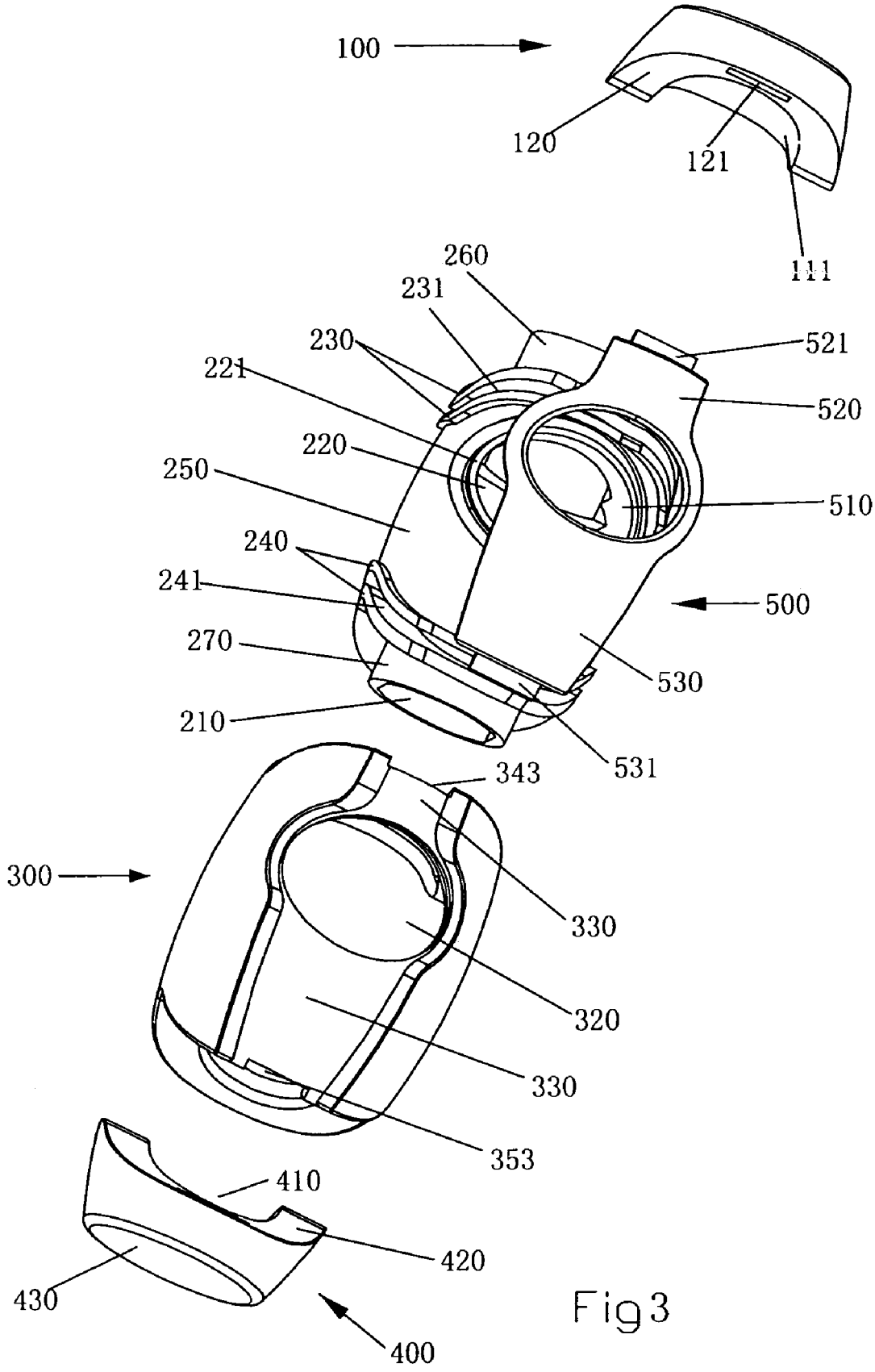
FIG. 3 is an exploded perspective view of the embodiment of FIG. 2.
Figures 1, 4:
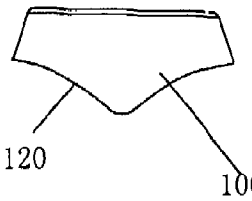
Figures 2, 4:
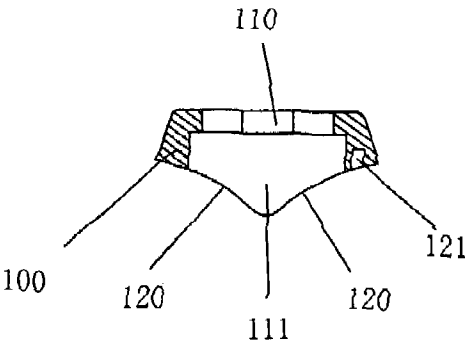
Figures 3, 4:
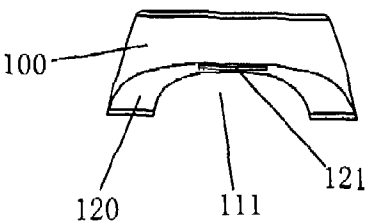
Figures 3, 5:
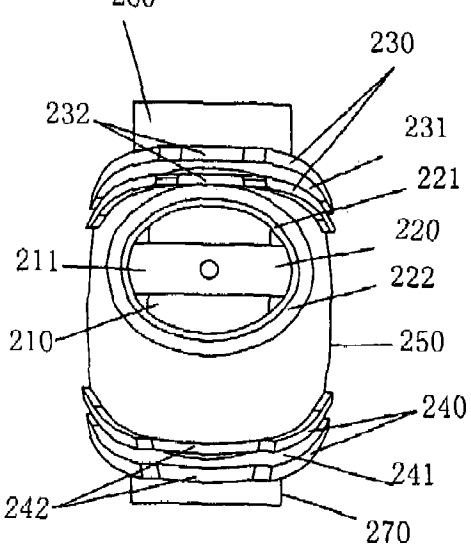
Figures 2, 5:
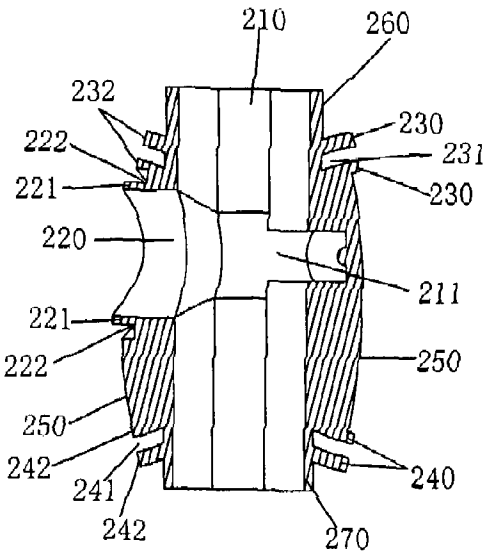
Figures 1, 5:
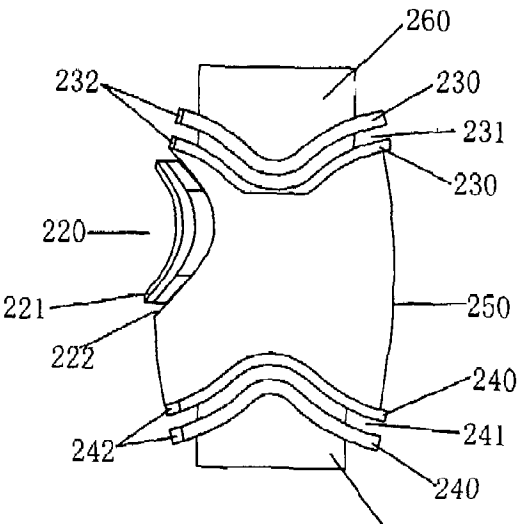
Figures 3, 8:
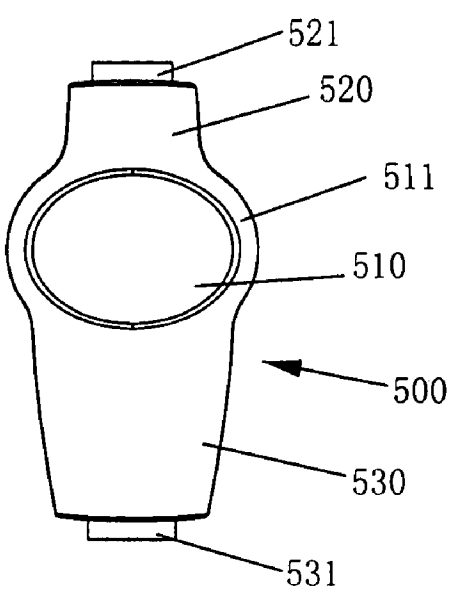
Figures 2, 8:
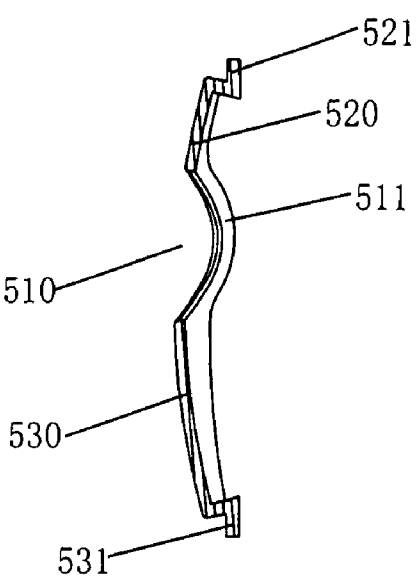
Figures 1, 8:
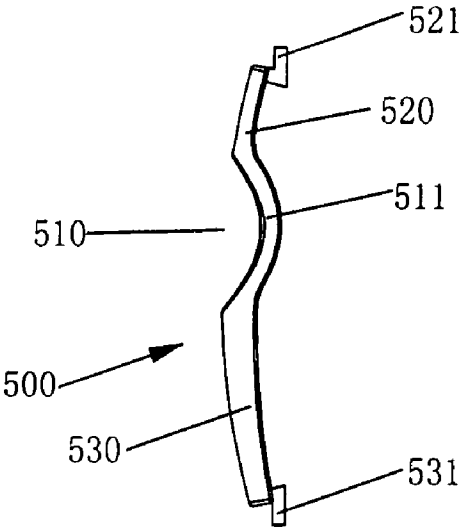

The exploded structure of the embodiment of the pliable handle on which a button is installed of the present utility model, as shown in FIGS. 2 and 3. The pliable handle includes: an upper rigid plastic cap 100, a rigid plastic core member 200, a flexible outer sheath 300, which is made of rubber or plastic, a lower rigid plastic cap 400, a rigid plastic cover board 500 and the gel 600.

Referring to FIG. 4-1, FIG. 4-2, FIG. 4-3, a longitudinal bore 110 for a central rod is set in the center of the upper cap 100. The diameter of the lower portion 111 of the longitudinal bore 110 is augmented for receiving the upper joint of the core member 100. A pair of protuberances is set at the lower portion of the upper cap 100, which divides the bottom surface 120 into 2 curved surfaces which curves upwardly. An oblong bore 121 is set in the middle of one curved surface.

Referring to FIG. 5-1, FIG. 5-2, FIG. 5-3, the core member 200 is in a drum shape, except the upper end and the lower end, its outer surface extends inwardly to contain the gel. A bore 210 is set in the core member 200 along the longitudinal axis of the core member, for locking the bottom of the central rod. A groove 211, which can contain a button that moves in radial direction, is set in the core member 200. A through opening 220 which corresponds to the groove 211 is defined by the side wall of the core member 200, and contains the button; an outwardly extending annular flange 221 is formed on the outer surface 250 of the core member, which corresponds to the through opening 220. An annular groove is formed on the outer surface of the outwardly extending annular flange 221 of the core member 200. An upper annular shoulder 230 is formed on the top of the core member 200, which protrudes outwardly. The two V-shaped curved portions are in the protuberance of the upper cap 100, which corresponds to the upper annular shoulder 230, an upper hermetical annular groove 231 is formed in the middle of the upper annular shoulder 230. A lower annular shoulder 240 is formed at the bottom of the core member 200, which protrudes outwardly. The two V-shaped curved portions are in the protuberance of the lower cap 400, which corresponds to the lower annular shoulder 240. A lower hermetical annular groove 241 is formed in the middle of the lower annular shoulder 240. A cylindrical upper joint 260 is extended from the center of the top of the core member 200. A cylindrical lower joint 270 is extended from the center of the bottom of the core member 200. For assembling the cover board 500, an upper surface 232 and a lower surface 242 are formed in the positions of the lower annular shoulder 240 and the upper annular shoulder 230 of the core member 200, the positions correspond to the outwardly extending annular flange 221.

Referring to FIG. 6-1, FIG. 6-2, FIG. 6-3, the hollow outer sheath has a drum shape. The inner space 310 contains the core member 200. The opening 320 is set on the side wall of the outer sheath 300, which contains the outwardly extending annular flange 221 of the core member 200. An inwardly extending annular flange 321, which corresponds to the groove 222 of the outwardly extending annular flange 221 of the core member is set inside of the opening 320 of the outer sheath 300. The hermetical loops 341, 342 is formed inside the top 340 of the outer sheath 300. The hermetical loops 341, 342 are parallel and protrude inwardly. There are two V-shaped curved portions in the hermetical loops 341, 342, which correspond to the upper annular shoulder 230 of the core member. The hermetical loops 351, 352 are formed inside the bottom 350 of the outer sheath 300. The hermetical loops 351, 352 are parallel and protrude inwardly. There are two V-shaped curved portions in the hermetical loops 351, 352, which correspond to the lower annular shoulder 240 of the core member. A longitudinal groove 330 is on the outer surface of the outer sheath 300 which corresponds to the opening 320, for assembling the cover board 500. An incision 343, which extends into the hermetical loops 341, is set on the top of groove 330. An incision 353 which extends into the hermetical loops 351 is set at the bottom of groove 330.

Referring to FIG. 7-1, FIG. 7-2, FIG. 7-3, a pair of protuberances which extend downwardly are on the top of the lower cap 400. The protuberances divide the top surface 420 into 2 curved surfaces which curve downwardly, an oblong bore 421 is set in the middle of one curved surface. A longitudinal bore 410 which contains the lower joint 270 of the core member 100 is set in the middle of the top surface of the lower cap 400. The diameter of the bottom 411 of the longitudinal bore 410 is minimized, which communicates with the bore 412. The bottom surface 430 of the lower cap 400 is smooth.

Referring to FIG. 8-1, FIG. 8-2, FIG. 8-3, a button bore 510, which corresponds to the through opening 220 of the side wall of the core member 200, is set on the cover board 500. The securing flange 520 is extended upwardly from the press-loop 511 of the middle of the cover board 500, the securing flange 530 extends downwardly from the press-loop 511 of the middle of the cover board 500. The end of the upper securing flange 520 of the cover board 500 is minimized and folded into the upper end 521, the end of the lower securing flange 530 of the cover board 500 is minimized and folded into the upper end 531.

During assembly, measure the gel and then get the quantificational gel. Put the gel on one side of outer surface 250 of the core member 200 which is furthest from the outwardly extending annular flange 221. The gel is extruded in a slice shape. The core member 200 with the gel is put into the inner space 310 of the outer sheath 300. The opening 320 of the outer sheath 300 faces the outwardly extending annular flange 221 of the core member 200 and the inwardly extending annular flange 321 of the opening 320 of the outer sheath 300 wedges into the groove 222 of the outwardly extending annular flange 221 of the core member 200. The hermetical loop 341 which is on the top of the outer sheath 300 engages with the top surface of the core member 200. The hermetical loop 342 which is on the top of the outer sheath 300 wedges into the upper hermetical annular groove 231 of the upper annular shoulder 230 of the core member 200. The lower hermetical loop 351 which is at the bottom of the outer sheath 300 engages with the bottom surface of the core member 200. The upper hermetical loop 352 which is at the bottom of the outer sheath 300 wedges into the lower hermetical annular groove 241 of the lower annular shoulder 240 of the core member 200. The gel is sealed between the inner wall of the outer sheath 300, which is far from the opening 320 of the outer sheath 300, and the outer 250 of the core member 200. The gel is formed the gel-body 600.

The button bore 510 of the cover board 500 faces the through opening 220 of the side wall of the core member 200, putting the cover board 500 on the longitudinal groove 330 which is on the surface of the outer sheath 300. The press-loop 511 which is in the middle of the cover board 500 is put on the wide portion of the middle of the groove 330. The upper end 521 of the securing flange 520 of the cover board 500 wedges into an incision 343 of the longitudinal groove 330. The upper end 531 of the securing flange 530 of the cover board 500 wedges into the incision 353 of the longitudinal groove 330. The gel is put on the outer surface of upper joint 260 of the core member 200 and the inner of the lower portion 111 of the longitudinal bore 110, respectively. The lower portion 111 of the longitudinal bore 110 faces the upper joint 260 of the core member 200. The oblong bore 121 of the bottom surface 120 of the upper cap 100 faces the upper end 521 of the securing flange 520 of the cover board 500. The upper cap 100 presses on the upper joint 260 of the core member 200. The bottom surface of the upper cap 100 presses on the hermetical loop 341 which is on the top of the outer sheath 300. The gap between the bottom surface of the upper cap 100 and the top surface of the core member 200 is sealed.

Coat the gel on the outer surface of the lower joint 270 of the core member 200 and the inner of the longitudinal bore 410 of the lower cap 400, respectively. The longitudinal bore 410 of the lower cap 400 faces the lower joint 270 of the core member 200. The oblong bore 421 of the top surface 420 of the lower cap 400 faces the upper end 531 of the securing flange 530 of the cover board 500, where the lower cap 400 presses on the lower joint 270 of the core member 200. the top surface of the lower cap 400 presses on the lower hermetical loop 351, which is at the bottom of the outer sheath 300, to cause the gap between the top surface of the lower cap 400 and bottom surface of the core member 200 to be sealed. At this point, the inwardly extending annular flange 321 of the opening 320 of the outer sheath 300 is wedged into the groove 222 of the outwardly extending annular flange 221 of the core member 200 by the press-loop 511 of the middle of the cover board 500, and it is sealed strictly. The upper securing flange 520 and the lower securing flange 530 press the two ends of groove 330 on the upper surface 232 of the upper annular shoulder 230 and the lower surface 242 of the lower annular shoulder 240, respectively. The bottom of the groove 330 of the outer sheath 300 is positioned between the cover board 500 and the outer surface 250 of the core member, where the gel is disposed between the bottom of the groove 330 of the outer sheath 300 and the outer surface 250 of the core member.

Figure 10:
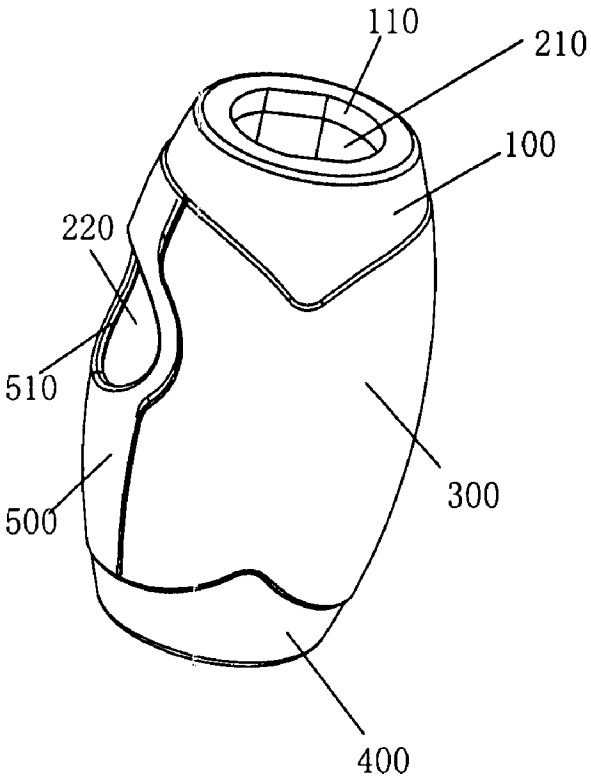
FIG. 10 is a perspective view of the assembled embodiment of FIG. 2.
Figure 9:
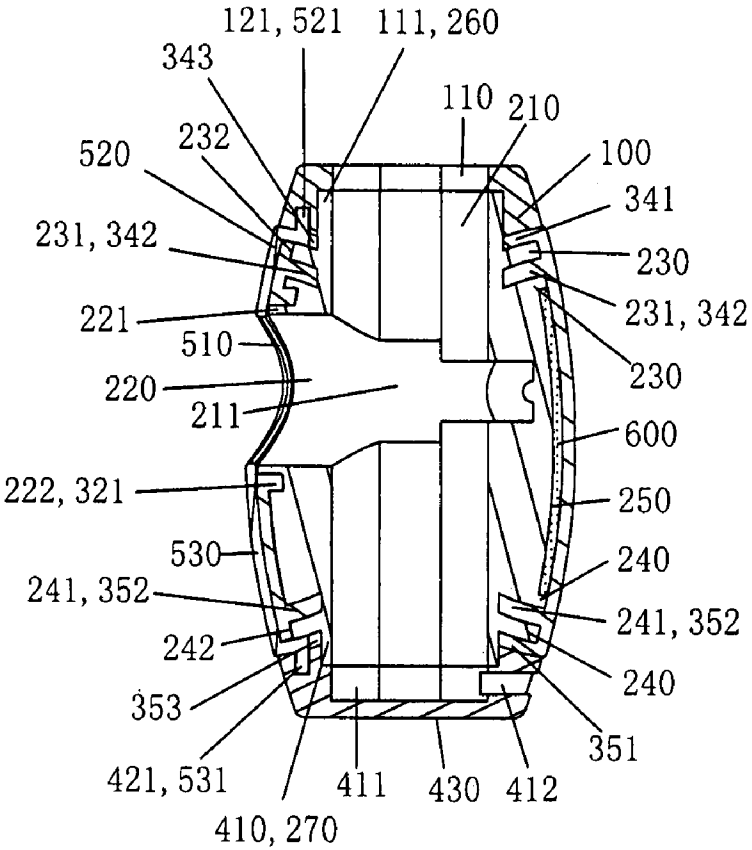
FIG. 9 is a cross-sectional view of the assembled embodiment of FIG. 2.
Figure 11:
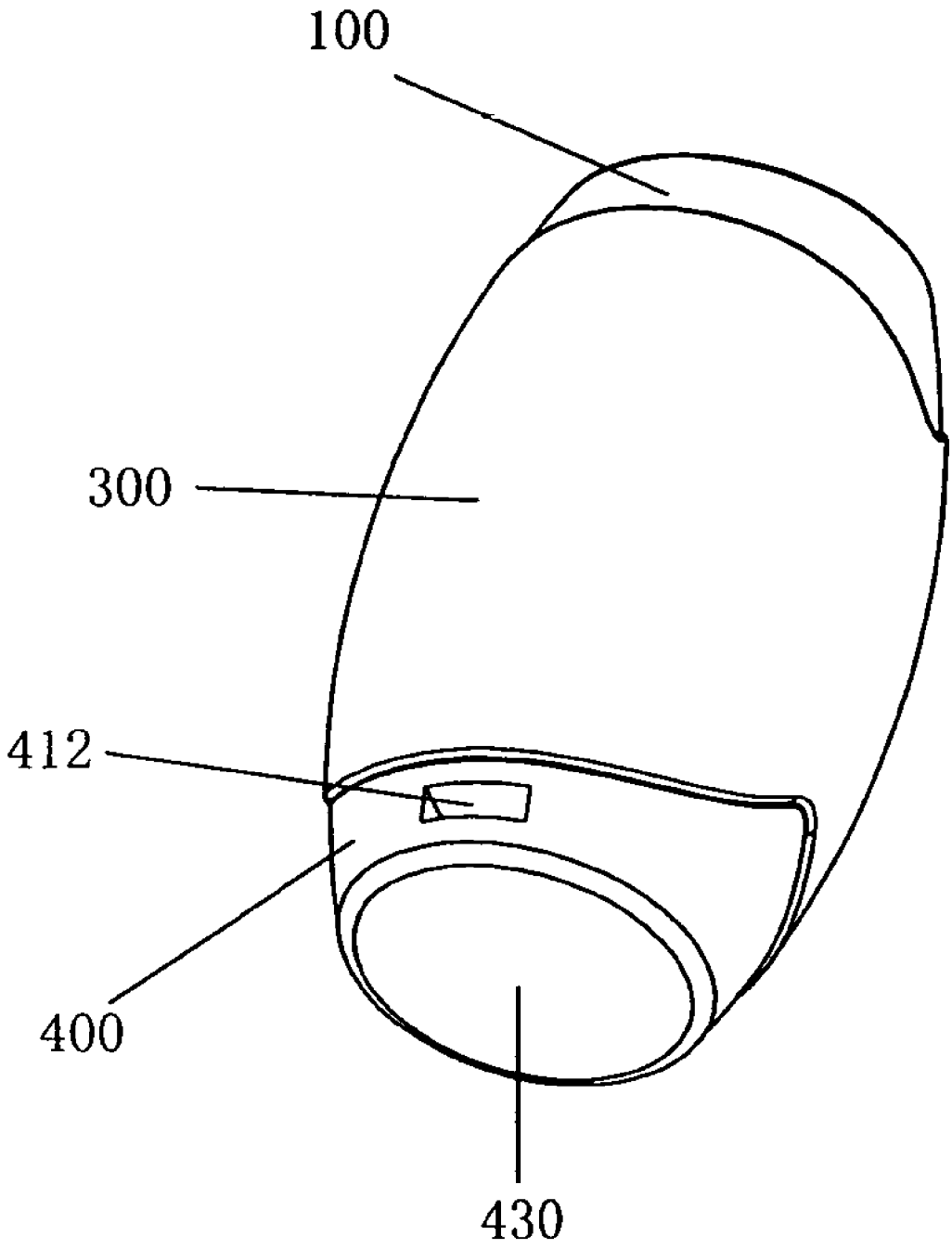
FIG. 11 is a perspective view of the assembled embodiment of FIG. 2 being viewed from another point.

FIG. 9 shows the cross-sectional view of the present embodiment after assembly. The stereogram, as shown in FIGS. 10 and 11 shows, after assembly. The flexible outer sheath 300 is positioned by the rigid upper cap 100 and the lower cap 400, and is securely fixed around the core member 200. The rigid cover board 500 presses on the periphery of the opening 320 of the outer sheath 300. The opening 320 of the outer sheath 300 is fixed on the outwardly extending annular flange 221 of the core member 200. At this point, the bottom of the buckle can be installed in the bottom 411 of the longitudinal bore 410 through the longitudinal bore 110 of the upper cap 100 and the bore 210 of the core member 200 downwardly, and through the lower cap 400. The ring of the buckle is led from the bore 421 through the button bore 510 of the cover board 500 and the opening 220 of the side wall of the core member 200. The button and its appended components are installed in the groove 211 in the side wall of the core member 200. The central rod of hand-held device is installed through the longitudinal bore 110 of the upper cap 100 and the bore 210 of the core member 200. The present embodiment is secured to the umbrella, walking stick and fishing pole. When people grip the outer sheath 300, the deformable gel disposed between the outer sheath 300 and the core member 200 deforms and conforms to the shape of the hand, the feel of hand is comfortable.

As mentioned above, it is the preferred embodiment of the present utility model. It will not limit the scope of the present utility model. The equivalent change and the modification based on the contents of the technical project and the specification of the present utility model belong to the scope of the present utility model.

What is claimed is:

1. A pliable handle on which a button can be installed, comprising:

a rigid core member with a bore set in the core member along the longitudinal axis of said core member for locking the bottom of a central rod, a flexible outer sheath is disposed about said core member hermetically, and deformable gel is disposed between said core member and said outer sheath;

wherein in said core member there is a space for containing said button, which can move in a radial direction, and there is a through opening for receiving said button in a side wall of said core member, said side wall corresponds to said space; an outwardly extending annular flange is formed on an exterior surface of said core member corresponding to the through opening; an opening is set on said flexible outer sheath for receiving said outwardly extending outer annular flange of said core member; said opening of said outer sheath covers said outwardly extending annular flange of said core member; and a rigid cover board having a button bore, which corresponds to the through opening, is pressed on the vicinity of the opening of said outer sheath, the opening of said outer sheath hermetically covers said outwardly extending annular flange of said core member.

2. The pliable handle on which a button can be installed as recited in claim 1, wherein an annular groove is formed on an exterior surface of said outwardly extending annular flange of said core member, an inwardly extending annular flange is set inside the opening of said flexible outer sheath and is wedged into said annular groove formed on said exterior surface of the outwardly extending annular flange of said core member.

3. The pliable handle on which a button can be installed as recited in claim 1, wherein said cover board has two securing flanges, which extend upwardly and downwardly, respectively, said two securing flanges correspond to the top and the bottom of said core member respectively.

4. The pliable handle on which a button can be installed as recited in claim 3, wherein a rigid upper cap is set on the top of said core member, a rigid lower cap is set on the bottom of said core member; there are two outwardly extending annular shoulders around the top portion and the bottom portion of said core member, and there is a hermetical annular groove in the middle of each shoulder; two hermetical loops are set at the top and at the bottom of said core member, the two hermetical loops are parallel and extend inwardly; the upper hermetical loop on the top of said outer sheath is wedged into the gap between said core member and said upper cap, said lower hermetic loop on the top of said outer sheath is wedged into said hermetical groove of an upper shoulder of said shoulders of said core member, said lower hermetic loop at the bottom of said outer sheath is wedged into the gap between said core member and said lower cap, said upper hermetical loop at the bottom of said outer sheath is wedged into said hermetical groove of a lower shoulder of said shoulders of said core member; the ends of securing flanges of said cover board are secured to said upper cap and said lower cap respectively.

5. The pliable handle on which a button can be installed as recited in claim 4, wherein two bores are respectively formed on said upper cap and said lower cap, the ends of said securing flanges of said cover board are wedged into the bores on said upper cap and said lower cap respectively.

6. A pliable handle on which a button can be installed, comprising:

a rigid core member with a bore set in the core member along the longitudinal axis of said core member for locking the bottom of a central rod, a flexible outer sheath is disposed about said core member hermetically, and deformable gel is disposed between said core member and said outer sheath;

wherein in said core member there is a space for containing said button, which can move in a radial direction, and there is a through opening for receiving said button in a side wall of said core member, said side wall corresponds to said space; an outwardly extending annular flange is formed on an exterior surface of said core member corresponding to the through opening; an opening is set on said flexible outer sheath for receiving said outwardly extending annular flange of said core member; said opening of said outer sheath covers said outwardly extending annular flange of said core member;

an annular groove formed on an exterior surface of said outwardly extending annular flange of said core member;

an inwardly extending annular flange set inside the opening of said flexible outer sheath and is wedged into said annular groove formed on said exterior surface of the outwardly extending annular flange of said core member; and a rigid cover board having a button bore, which corresponds to the through opening, said cover board is pressed on the vicinity of the opening of said outer sheath, the opening of said outer sheath hermetically covers the outer flange of the core member.

* * * * *